US010821773B2

(12) United States Patent
Cheng

(10) Patent No.: US 10,821,773 B2
(45) Date of Patent: Nov. 3, 2020

(54) PAINT BRUSH AND PAINT STORAGE CONTAINER, DEVICE, KIT AND SYSTEM FOR USE ON PORTABLE TOUCH-UPS

(71) Applicant: Vincent Cheng, Burnaby (CA)

(72) Inventor: Vincent Cheng, Burnaby (CA)

( * ) Notice: Subject to any disclaimer, the term of this patent is extended or adjusted under 35 U.S.C. 154(b) by 0 days.

(21) Appl. No.: 15/554,434

(22) PCT Filed: Mar. 21, 2016

(86) PCT No.: PCT/CA2016/000078
§ 371 (c)(1),
(2) Date: Aug. 30, 2017

(87) PCT Pub. No.: WO2016/149791
PCT Pub. Date: Sep. 29, 2016

(65) Prior Publication Data

US 2018/0043731 A1 Feb. 15, 2018

(30) Foreign Application Priority Data

Mar. 20, 2015 (CA) ..... 2885599

(51) Int. Cl.

| | |
|---|---|
| ***B44D 3/12*** | (2006.01) |
| ***B25F 1/00*** | (2006.01) |
| ***B65D 25/20*** | (2006.01) |
| ***B65D 45/16*** | (2006.01) |
| ***B65D 53/00*** | (2006.01) |
| ***E04G 23/02*** | (2006.01) |
| ***B44D 3/06*** | (2006.01) |

(52) U.S. Cl.
CPC ..... *B44D 3/123* (2013.01); *B25F 1/00* (2013.01); *B44D 3/127* (2013.01); *B65D 25/20* (2013.01); *B65D 45/16* (2013.01); *B65D 53/00* (2013.01); *E04G 23/02* (2013.01); *B44D 3/06* (2013.01); *B44D 3/128* (2013.01)

(58) Field of Classification Search
CPC ..... B44D 3/123; B44D 3/127; B44D 3/06; B44D 3/128; E04G 23/02; B65D 53/00; B65D 45/16; B65D 25/20; B25F 1/00; A47G 19/2272
USPC ..... 220/212, 736, 735, 802; 206/209, 15.3; 15/248.1
See application file for complete search history.

(56) References Cited

U.S. PATENT DOCUMENTS

| | | | | |
|---|---|---|---|---|
| 2,905,419 | A * | 9/1959 | Carson | B44D 3/123 248/110 |
| 5,366,089 | A * | 11/1994 | Parker | A45C 11/20 206/546 |
| 6,041,919 | A | 3/2000 | Adams | |
| 6,213,329 | B1 | 4/2001 | Dobson | |
| 6,321,937 | B1 * | 11/2001 | DeSimone | A47K 10/3818 221/45 |
| 6,494,315 | B2 | 12/2002 | Frisk | |
| 8,087,554 | B2 * | 1/2012 | Gringer | B44D 3/127 220/696 |

(Continued)

*Primary Examiner* — Anthony D Stashick
*Assistant Examiner* — James M Van Buskirk
(74) *Attorney, Agent, or Firm* — KA Filing LLC; Wayne V. Harper

(57) ABSTRACT

A device for use in paint touch ups comprises a container, holding paint, its lid having a channel there through to securably accommodate a brush handle (and in the absence of a handle, being otherwise plugged shut) and a flexibly placed accessories box.

18 Claims, 16 Drawing Sheets

(56) References Cited

U.S. PATENT DOCUMENTS

| | | | | |
|---|---|---|---|---|
| 8,322,913 | B2 * | 12/2012 | Galowina | B65D 23/102<br>366/208 |
| 8,967,414 | B2 * | 3/2015 | Lane | A47G 19/2272<br>220/284 |
| 9,108,776 | B2 * | 8/2015 | Smyers | B65D 53/00 |
| 2007/0295723 | A1 * | 12/2007 | Mak | G01F 19/00<br>220/23.86 |

* cited by examiner

FIG 7
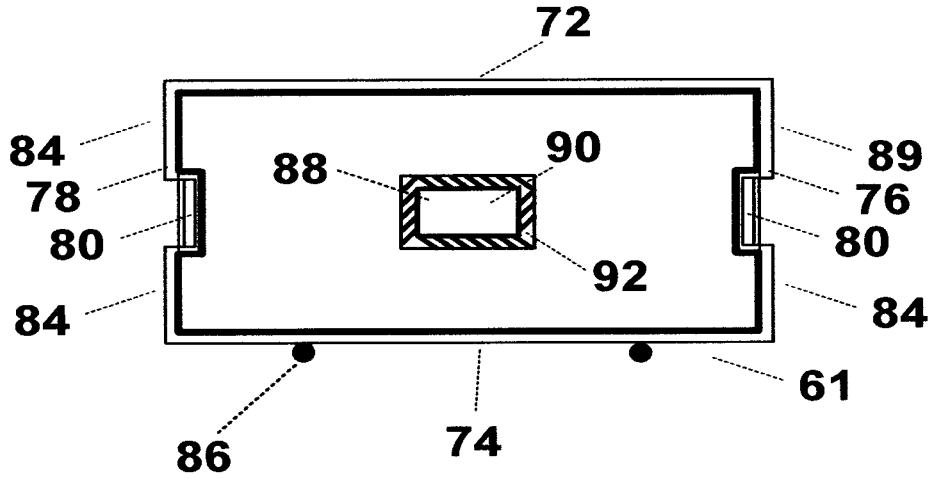
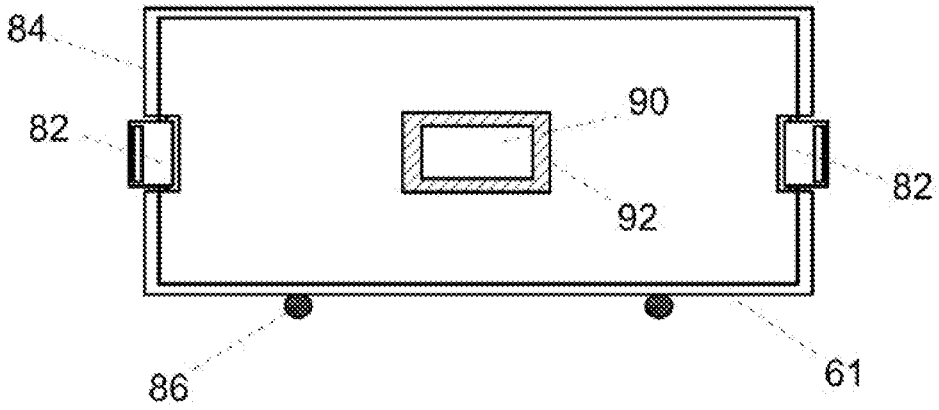
FIG 8

PAINT BRUSH AND PAINT STORAGE CONTAINER, DEVICE, KIT AND SYSTEM FOR USE ON PORTABLE TOUCH-UPS

FIELD OF THE INVENTION

This invention relates generally to the field of portable paint storage containers.

BACKGROUND OF THE INVENTION

Painting is the most popular method of improving the appearance of interior and exterior walls, in the residential and commercial spaces. Private individuals, businesses and governments spend thousands if not millions of dollars repainting walls to clean them up, to remove scuff marks and repair paint damage, even if the damage and scuffs only amount to about 1-2% of the surface area, while the rest of wall surface is completely perfect.

The process for a typical paint repair is a simple but time consuming process and in fact it may take hours of valuable time. This includes finding the many tools needed, painting and clean up. Generally, tools required are the paint (with the correct color and finish), a clean paint tray, a means to open the paint can, a stir stick, a paint brush, and a means to clean the brush. The scratched or scuffed area is painted and the brush cleaned and all tools put away. Large paint containers must be stored and take up significant space. This is an issue, for example, if a business has 4-5 different paint colours used on site that may need periodic touch ups.

Due to the onerous nature of all of this work simply to do a touch up, the task often remains uncompleted until the point at which the entire wall or surface needs attention. Until that point, the scratches and scuff marks and chipped paint becomes an ever-increasing eye-sore.

There are products which reduce the number of steps required to touch up painted surfaces. A product called Qwikie, comprises a container in which paint is stored and a small brush is attached to the lid of the container. It is noted that the brush of this tool is small which makes the entire product less useful.

Some types of products utilize a paint roller connected to a handheld paint storage apparatus. There are some serious drawbacks to these devices such as the inability to control the amount of paint on the roller, and ever-present dripping. Furthermore, the rollers quickly dry out and need to be replaced. Some examples of such products are the Paint Buddy sold by Rubbermaid; the Shur-Line Touchup painter; and the Paint Touchup Tool Roller & Bottle by Woolie.

It is an object of the present invention to obviate or mitigate all of the above noted disadvantages.

SUMMARY OF THE INVENTION

It is an object of this invention, in one aspect, to provide a device for use in easy and convenient paint touch up tasks.

It is an object of this invention to provide a device for use in easy and convenient paint touch up tasks wherein a brush and a paint container may be stored and used together, wherein the lid of the container is functionally useable with the brush as a convenient drip-catcher but is also completely removable from the brush so that brush can be replaced and/or cleaned as required.

It is an object of this invention to provide a device for use in easy and convenient paint touch up tasks wherein brush and paint container and stored and used together, and there is provided there between an airtight sealing mechanism.

It is an object of this invention to provide a device for use in easy and convenient paint touch up tasks wherein brush and a paint container are stored and used together and wherein at least one accessories box is removably engagable with the container at either one or two positions, relative to the container, above and/or below.

It is an object of this invention to provide a device for use in making the cutting wherein the brush and a paint container is used together to paint the edges of the room.

In one aspect, the present invention provides a device for use in paint touch-ups using a brush comprising a handle, bristles and a ferrule, the device comprises:

a) a paint container for holding paint, said container comprising a top, a bottom and body there between, wherein said top comprises an opening to the interior of the body;

b) a lid which is engagable with the top to provide a removable sealing and closure thereof, said lid comprising an aperture and a paint brush channel through the lid, such that, when stored in the device, the handle extends outwardly away from the container and is grippable above the container, said handle extendable through an aperture and channel in the lid and through the paint brush channel so that the ferrule and the bristles are disposed within the body of the container; wherein the aperture and channel comprise a substantially air-tight, brush-holding seal while at the same time enabling detachment of the brush from the lid, when a replacement of the brush is desired, said substantially air-tight, brush-holding seal, when a brush is in place, enabling suspension of the brush above the bottom of the container; and c) at least one sealable accessories box removably attachable to the container.

In one aspect, the present invention provides a device for use in paint touch-ups using a brush comprising a handle, bristles and a ferrule, the device comprises:

a) a paint container for holding paint, said container comprising a top, a bottom and body there between, wherein said top comprises an opening to the interior of the body;

b) a lid which is engagable with the top to provide a removable sealing and closure thereof, said lid comprising an aperture and a channel through the lid, such that, when in use and/or stored in the device, the handle may be securably placed therein, said aperture and channel comprising a substantially air-tight, brush-holding seal;

c) a plug for sealing the aperture; and d) at least one sealable accessories box removably attachable to the container.

The advantages of the device of the invention are many fold. There is provided an "All-in-One" paint repair tool that dramatically makes the repair and painting process easier, faster, cheaper and more efficient. The tool will also help people to keep new paint jobs looking new and clean for a longer time with little effort. The device body holds paint for an extended period of time, due to the sealing mechanisms. The easy disengagement of the accessories box and connection/disconnection of the brush, attached to the anti-drip lid means the touch up task is completed a 2-3 very easy steps. At the conclusion, the lid is simply screwed or snapped back on (optionally with brush attached) and the accessories box re-engaged.

These and other advantages will become apparent throughout this specification.

BRIEF DESCRIPTION OF THE DRAWINGS

FIG. 7 is a top plan view of the lid;

FIG. 8 is a bottom plan view of the lid;

Figure 1:
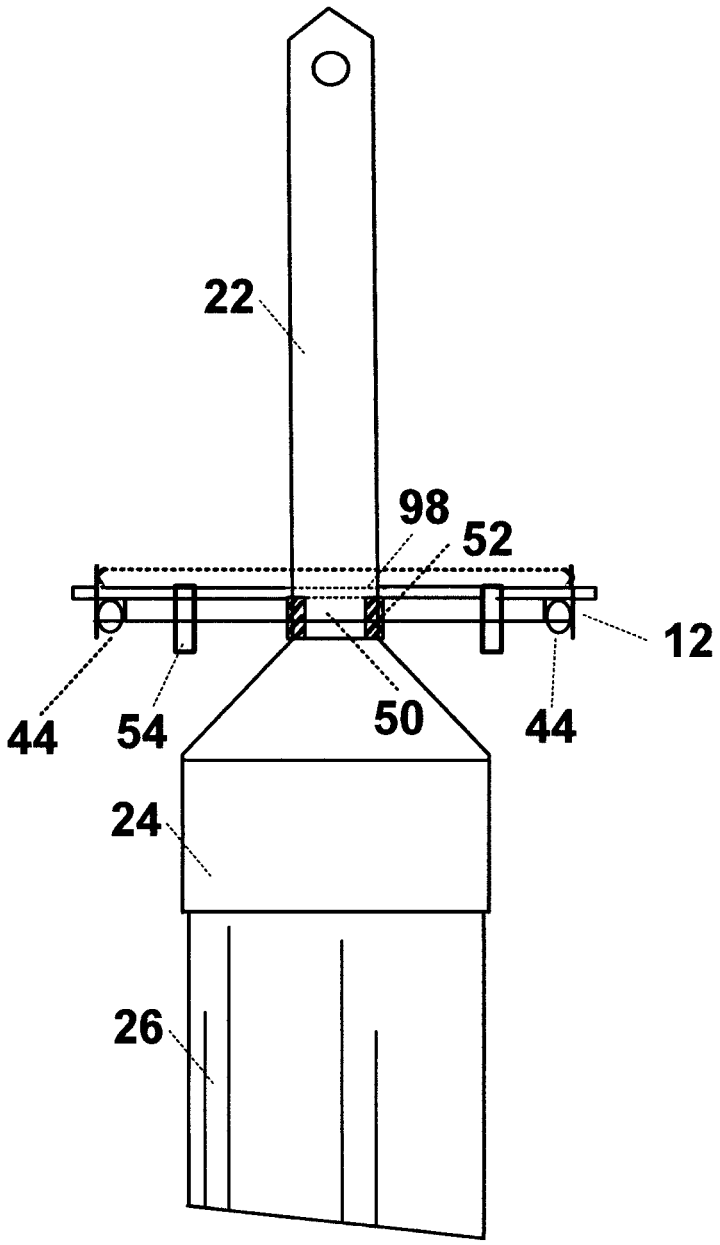
FIG. 1 is a front plan view of a lid with an engaged or removably attached paint brush.

The figures depict embodiments of the present invention for purposes of illustration only. One skilled in the art will readily recognize from the following description that alternative embodiments of the structures and methods illustrated herein may be employed without departing from the principles of the invention described herein.

DETAILED DESCRIPTION OF THE PREFERRED EMBODIMENTS

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I. Terms

The term "product" means any machine, manufacture and/or composition of matter, unless expressly specified otherwise.

The term "method" means any process, method or the like, unless expressly specified otherwise.

Each process (whether called a method or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

The term "invention" and the like mean "the one or more inventions disclosed in this application", unless expressly specified otherwise.

The terms "an aspect", "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise.

The term "variation" of an invention means an embodiment of the invention, unless expressly specified otherwise.

A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present application, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase "at least one of a widget, a car and a wheel" means either (i) a widget, (ii) a car, (iii) a wheel, (iv) a widget and a car, (v) a widget and a wheel, (vi) a car and a wheel, or (vii) a widget, a car and a wheel. The phrase "at least one of", when such phrase modifies a plurality of things does not mean "one of" each of the plurality of things.

Numerical terms such as "one", "two", etc. when used as cardinal numbers to indicate quantity of something (e.g., one widget, two widgets), mean the quantity indicated by that numerical term, but do not mean at least the quantity indicated by that numerical term. For example, the phrase "one widget" does not mean "at least one widget", and therefore the phrase "one widget" does not cover, e.g., two widgets.

The phrase "based on" does not mean "based only on", unless expressly specified otherwise. In other words, the phrase "based on" describes both "based only on" and "based at least on". The phrase "based at least on" is equivalent to the phrase "based at least in part on".

The term "represent" and like terms are not exclusive, unless expressly specified otherwise. For example, the term "represents" do not mean "represents only", unless expressly specified otherwise. In other words, the phrase "the data represents a credit card number" describes both "the data represents only a credit card number" and "the data represents a credit card number and the data also represents something else".

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "e.g." and like terms mean "for example", and thus does not limit the term or phrase it explains.

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

The term "i.e." and like terms mean "that is", and thus limits the term or phrase it explains. For example, in the sentence "the computer sends data (i.e., instructions) over the Internet", the term "i.e." explains that "instructions" are the "data" that the computer sends over the Internet.

Any given numerical range shall include whole and fractions of numbers within the range. For example, the range "1 to 10" shall be interpreted to specifically include whole numbers between 1 and 10 (e.g., 1, 2, 3, 4, . . . 9) and non-whole numbers (e.g. 1.1, 1.2, . . . 1.9).

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to".

Neither the Title (set forth at the beginning of the first page of the present application) nor the Abstract (set forth at the end of the present application) is to be taken as limiting in any way as the scope of the disclosed invention(s). An Abstract has been included in this application merely because an Abstract of not more than 150 words is required under 37 C.F.R. .sctn.1.72(b). The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural and logical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

No embodiment of method steps or product elements described in the present application constitutes the invention claimed herein, or is essential to the invention claimed herein, or is coextensive with the invention claimed herein, except where it is either expressly stated to be so in this specification or expressly recited in a claim.

II Overview

The invention provides a device which solves a needed problem—that of easily and quickly and inexpensively doing paint touch ups on a small scale. This is the type of touch up common not only in residences but in commercial operations such as hotels and restaurants, wherein wear and tear on wall pain might occur on a daily/weekly basis. The device of the invention solves the problems of prior products, which have attempted unsuccessfully to address this issue. The device of the invention provides a lid with a unique brush engagement means such that the lid is attached to a brush during tasks to act as a drip-catcher but the brush is readily removable from the lid for replacement and deep cleaning as and if required. The prior products do not allow or account for this.

The unique brush-engaging lid arrangement of the invention further provides a secure air-tight seal to ensure non-leakage and non-spoilage of the paint while at the same time the seal does not impede disengagement of brush as noted above, when needed. By this means, brushes of somewhat differing sizes can be used or re-used with the same container. More specifically the brush-holding air-tight seal accommodates handles of a range of sizes/shapes.

The unique brush-lid arrange of the invention further provides a means by which the brush is held in the container, in the paint solution itself (to avoid dry out) but above the bottom surface of the container to avoid damage to and bending of the bristles of the brush.

Furthermore, the device of the invention additionally comprises at least one accessories box and the engagement of the box at one or two positions relative to the container. In one aspect, this box snaps into place under the container when contents are not needed to be accessed. In another aspect, as described further herein, an accessories box comprises a hollow brush-handle engaging passage such that it can snap into place above the container. This embodiment provides a more size-contained device for shipping and transportation. In this aspect, the brush-handle engaging passage comprises sealing means similar to the lid sealing means through which the brush handle may also pass, when in use. In another aspect, as described further herein, an accessories box may be both snapped into place above the container, when the device is not in use and also snapped into place under the container (for convenience) when contents of the box are not needed to be accessed during actual use of the lid/brush.

III Details

The present invention provides a device for use in paint touch-ups using a brush comprising a handle, bristles and a ferrule, the device comprises: a paint container for holding paint, said container comprising a top, a bottom and body there between, wherein said top comprises an opening to the interior of the body; a lid which is engagable with the top to provide a removable sealing and closure thereof, said lid comprising an aperture and a paint brush channel through the lid, such that, when stored in the device, the handle extends outwardly away from the container and is grippable above the container, said handle extendable through an aperture and channel in the lid and through the paint brush channel so that the ferrule and the bristles are disposed within the body of the container; wherein the aperture and channel comprise a substantially air-tight, brush-holding seal while at the same time enabling detachment of the brush from the lid, when a replacement of the brush is desired, said substantially air-tight, brush-holding seal, when a brush is in place, enabling suspension of the brush above the bottom of the container; and at least one sealable accessories box removably attachable to the container.

In another aspect, the present invention provides a device for use in paint touch-ups using a brush comprising a handle, bristles and a ferrule, the device comprises: a paint container for holding paint, said container comprising a top, a bottom and body there between, wherein said top comprises an opening to the interior of the body; a lid which is engagable with the top to provide a removable sealing and closure thereof, said lid comprising an aperture and a channel through the lid, such that, when in use and/or stored in the device, the handle may be securably placed therein, said aperture and channel comprising a substantially air-tight, brush-holding seal; a plug for sealing the aperture; and at least one sealable accessories box removably attachable to the container.

Accessories Box:

In one aspect, the accessories box is removably attached to the bottom of the container. In one aspect, wherein box is removably attachable to the top of the container, the accessories box comprises a top, a bottom and a body there between and additionally comprises a hollow channel extending between the top and the bottom, said box providing a storage space in an interior of the body around the hollow channel, said hollow channel comprising a second brush holding seal such that when the device is not in use, the accessories box is positionable on top of the container, with the handle of the brush extending through the hollow channel and secured in place by the second brush holding seal.

In one aspect, the accessories box is removably attached to the bottom of the container. In this way, the box can simply comprise a removable lid or a side wall entry point of access to the box contents. The lid of the accessories box preferably engages by snap or lock in mechanism to the bottom surface of the container. Alternatively, attachment may be via an adapter between the box and the container.

In another aspect, the accessories box comprises a top, a bottom and a body there between and additionally comprises a hollow channel extending between the top and the bottom, said box providing a storage space in an interior of the body around the hollow channel, said hollow channel comprising a second brush holding seal such that when the device is not in use, the accessories box is positionable on top of the container, with the handle of the brush extending through the hollow channel and secured in place by the second brush holding seal.

Essentially, in operation, the paintbrush handle penetrates through the hollow channel of the box. The brush is held in place by the brush holding seal, with lines the hollow channel of the box.

This arrangement of the box removably securable above or on top of the container creates a more size efficient device while still creating an accessory storage space. It is to be understood that items within the box are securely held as the brush handle accommodating channel is not "open" to the inside of the box. The box has interior walls on all sides that securely hold the contents of the box.

Preferably, brush holding seal is created by the "exterior" channel walls being lined with air tight foam or silicone or other material that will securely grip the paint brush handle (once in place) which holds the box in place while sitting on the paint container (the brush handle further extending downwards through the container lid aperture and handle. As a bonus, this holding seal (preferably foam) will also be an additional level of defense in restricting air from entering the paint storage container below. With the box astride the container, the entire device is more compact and easier to ship and store. In a most preferred form, the lid of the box is additionally enabled to attach to the bottom of the container so a user can choose to remove the accessories box from the top of the device and then to attach it to the bottom of the container if the users so chooses. In many cases, a user will be walking around many rooms and it would be more convenient to have the accessories box attached rather than misplacing it. Hence the bottom attachment point. There are a variety of means to achieve such attachment including latches, snaps, mating connections etc. . . .

To be clear, in one aspect of the invention, the accessories box is attachable both at the top (above the container) via passage of the handle through the hollow channel which cuts through the accessory box and below the container, preferably via a snap on attachment means.

In one aspect the accessories box comprises a clear lid that allows the user to see the content of the box. The lid of the box can be a standard lid or a lid with a hinge and latch.

Preferably, the brush holding seal (in the hollow or channel of the accessories box) comprises foam or silicone. In one aspect, the channel comprises either a foam-lined neck a silicone neck and comprises at least two washers, one disposed above the neck and one below the neck to assist in holding the brush in place, in relation to the accessories box.

The accessories box may comprise any number of small tools and parts to facilitate the repairing and painting touch up process. It may comprise one or more the following: putty, putty knife, sand paper, drywall mesh tape and paper, paint edging tape and sealed paint remover-soaked handy cloths such as, for example moist wet wipes.

The device may additionally comprise a paint stir stick.

Lid Details

The lid is a removable top to the container. It comprises an aperture/paint brush channel (paint brush engaging channel) in addition to fastener/latches/snaps/mating means or other means of removably secured attachment and closure of the lid on the top of the container. The paint brush channel comprises and is lined by an airtight brush holding seal which in a preferred form is foam or silicone. This brush holding seal serves several functions including (when brush is stored in the container) suspending the brush in place to prevent the brush from dropping into the paint or deforming the paint brush bristles by contact with the base or bottom of the container. The brush holding seal comprises a material which is suitably deformable such that a brush handle may be not only inserted and removed (with some pressure) but, once in place held there during storage and use of the brush. In other words, during use of the brush during touch ups, the brush and lid operate together, with the lid providing a number of functionalities. Firstly, the lid, in use and connected to the brush, acts an as anti-drip tray. Secondly, the lid may optionally include pegs, for resting of the lid and brush on edges of cans, vessels or other objects. Thirdly, with the lid and brush acting as one unit, replacement onto the container is simple and quick. However, critically, the brush is removably as needed whether for replacement, deep cleaning of the brush, painting without the lid/tray or optionally for storage of the device without the brush. In the latter, the aperture in the lid is replaced with an aperture-sized airtight plug. This plug fills the hole that would otherwise be taken by the brush handle and prevents air from drying out and compromising the paint.

The airtight, brush holding seal, forming part of the lid, is a key aspect of the invention. Preferably the seal comprises a resilient foam or silicone. In one aspect, the airtight, brush holding seal comprises a silicone neck to assist in holding the brush in place, in relation to the lid. In another aspect, the airtight, brush holding seal comprises a silicone neck and at least two washers, one disposed above the silicone neck and one below the silicone neck to assist in holding the brush in place, in relation to the lid.

Fastener/latches/snaps/mating means or other means (the lid fastening means) removably secure attachment and closure of the lid on the top of the container The lid fastening means must restrict the movement of air into the painter storage unit when lid is in closed position The container lid may also be used as a brush rest.

Preferably, the lid comprises pegs for suspension of the brush onto one of lips or edges of other vessels, when in use, said pegs being oriented such that weight of the brush serves to facilitate hanging the brush against a wall of the vessel.

It is most preferred that the lid is twist off.

It is to be understood that size/shape of the aperture/channel in the lid, combined with the brush holding seal is customizable to brush handle sizes, as desired during manufacturing. It is further understood that the size/shape of the aperture/channel in the lid, combined with the brush holding seal allows some flexibility in the degree to which the lid "goes down" the brush handle thereby allowing a painter/user of the device to hold the brush in his/her desired "sweet spot" which increases the painters/users comfort and control of the unit. This type of adjustment is enabled by the unique aperture/channel in the lid, combined with the brush holding seal of the invention.

Preferably, the aperture in the lid of the container is oval or a short slit-like opening although other shapes are workable as well, with the air-tight seal, as described herein.

Brushes

Many types of paint brushes are usable in the device of the invention. Brushes comprise the general parts as shown in FIG. 18—bristles, handle, and ferrule.

The handle of a brush is most often made from wood that is painted and/or varnished, but it can also be made from plastic or bamboo. The toe of a brush is the very end of the bristles, while the heel is where the bristles go into the ferrule at the end the handle (not usually seen without taking a brush apart). The belly is, as the name would suggest, the fattest part of a brush. (it is most obvious on a round brush, rather than a flat one.).

Bristles are sometimes referred to as hairs or filaments, bristles make up the head of the brush called the brush head. This is the part of the brush that holds the paint. They be made from natural hair, synthetic fibers, or combination of both. Natural bristles are made from some sort of animal hair, such as hog or badger. Synthetic bristles are often made from nylon, polyester, or a combination of both.

The ferrule of a brush is the metal band that connects the bristles to the handle and the crimp is the part of the ferrule that secures it to the handle. Ferrules can be made from tin, aluminum, brass or copper alloys that are nickel or chrome plated. Better quality brushes have a brass or copper alloy ferrule. These types have the best adhesion to the handle and a double or triple crimp. This is important because if the ferrule does not fit properly, the bristles will fall out or the ferrule could come off the handle.

Container

Preferably, the device comprises a spill collar is disposed around an exterior surface of the container, proximate to the top.

As noted herein, there may be provided a removable seal between the lid and the container. In one aspect, this seal may be made of foam. In another aspect, this seal is made of silicone. It is to be understand that other liquid-proof, air-proof seal materials may readily be employed for this purpose.

The general shape of the container may preferably be square, oval, or tubular/circular. In one aspect, any portion of the device which holds paint is round as opposed to comprising corners in order to be easier to clean and to access paint (i.e. no corners).

In one aspect, there may be ring attachments to the containers to allow the user to insert a thumb or finger into the ring for a more securely hold on the containers.

FIGURES

Various aspects of the invention will now be described with specific reference to the figures, where like numerals denote the same components across all figures.

Figure 5:
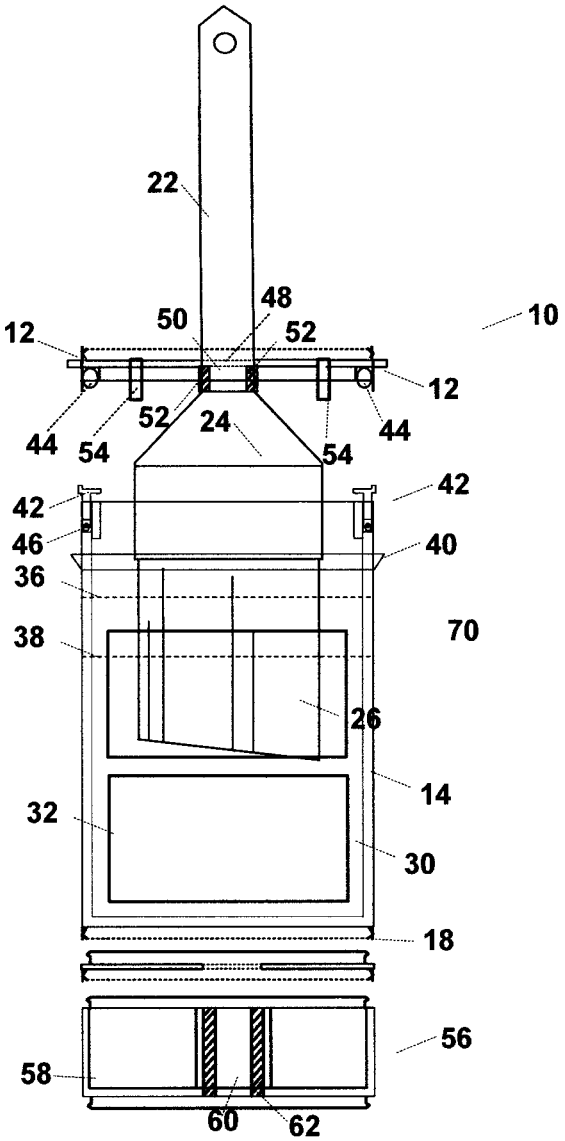
FIG. 5 is a front plan view of the entire device, showing lid disengaged from top of the container and brush attached to lid.

FIG. 5 provides a front plan view of a device shown generally at 10, with lid 12, container 14 (having top end 16 and bottom surface 18) wherein brush 20 (having parts being handle 22, ferrule 24 and bristles 26) is shown in partial disengagement from body 28 of container 14. Paint 30 is held within body 28. On an exterior surface of container 14, labels 32 and 34 can be used to provide detail on contents, paint colour and notes for user etc. Maximum paint fill line 36 and minimum fill line 38 are provided on walls of the container. Spill collar 40 extends outwardly from container 14 under top 16.

In regards to top 16 of container 14, two latches 42 extend upwardly for mating with lid 12. These latches rotate for engagement with lid to ensure a tight fit.

In regards to lid 12, seal 44 (which may be silicone) provides a molded seal with top edge 46 of container 14. The seal enables secure closure of the lid on the container, by way of the latches. Furthermore, the seal may be covered in paint and yet will not preclude the next opening of the lid as the dried pain encrusted seal will simply pull away from the lid, on pressure for opening. The seal can be cleaned of the dried paint prior to the following use and re-engaged in place. Were such a seal not in place, the risk would be the paint dried bonding the lid to top edge. It is not desired within the scope of the invention that the lid is attached of the container by a threaded cap-type means. The reason for this is that threads will be caked with dried paint after one use and a "seal" cannot be readily be broken, as per the unique arrangement provided herein.

Lid 12 comprises aperture 48 and channel 50 through which handle 22 passes. Channel 50 is lined with an air-tight, brush holding seal 52. Lid 12 further comprises brush suspending pegs 54.

FIG. 1 is a front plan view of a lid 12 with an engaged or removably attached paint brush 20 and provides further detail of lid 12. Brush holding seal 52 secure the placement of handle 22 on one side the lid and ferrule 24 on the other side of the lid.

Figure 2:
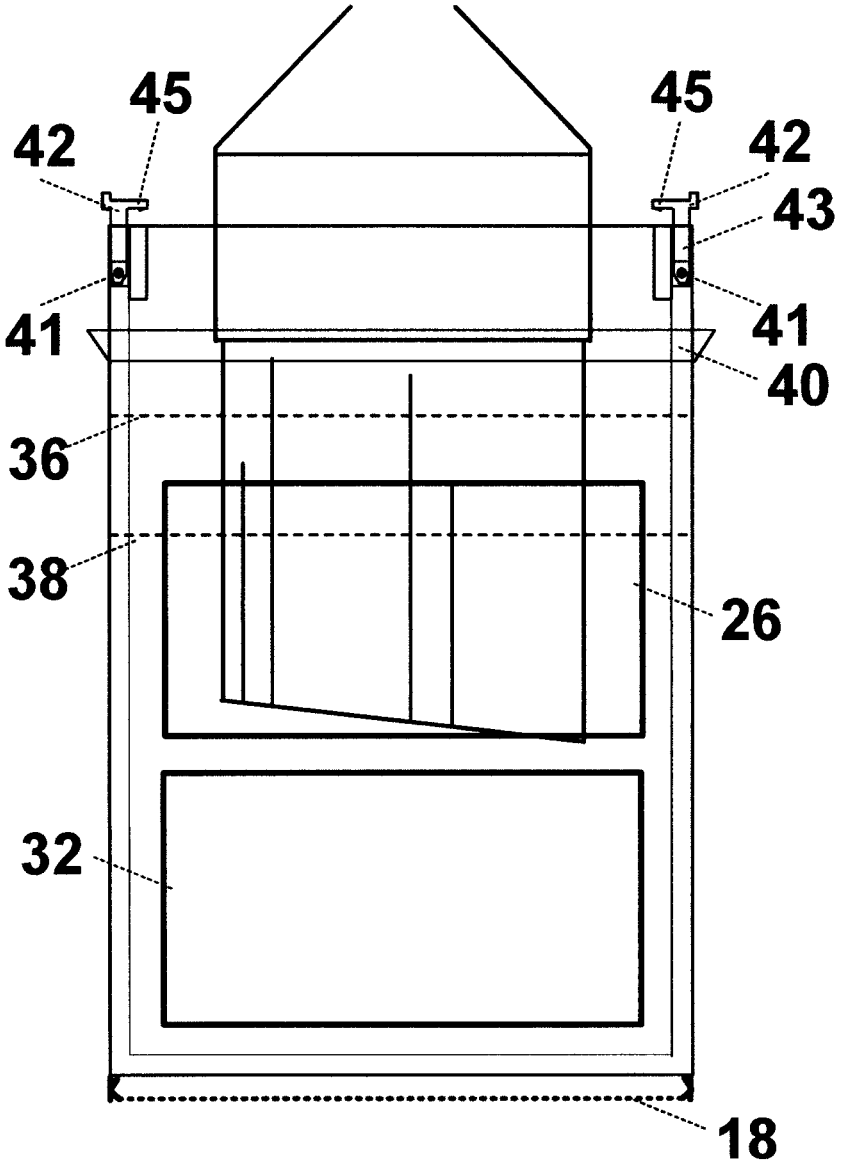
FIG. 2 is a front plan view of the container.

FIG. 2 is a front plan view of container 14 showing a bit more close-up view of a section of device of FIG. 5 with the rotatable latches 42 being more easily seen. Latches 42 each pivot around pivot points 41 such that arms 43 pull away from container 14 and then snap back into place, with clasps 45 on either side then securing lid 12 in situ. With this closure operation, between lid 12 and top edge 46, each abuts seal 44, pressing against said seal to ensure air and liquid tight containment. The seal as noted is removable for cleaning of residual paint debris or, if damaged, replacement with a new seal.

Figure 3:
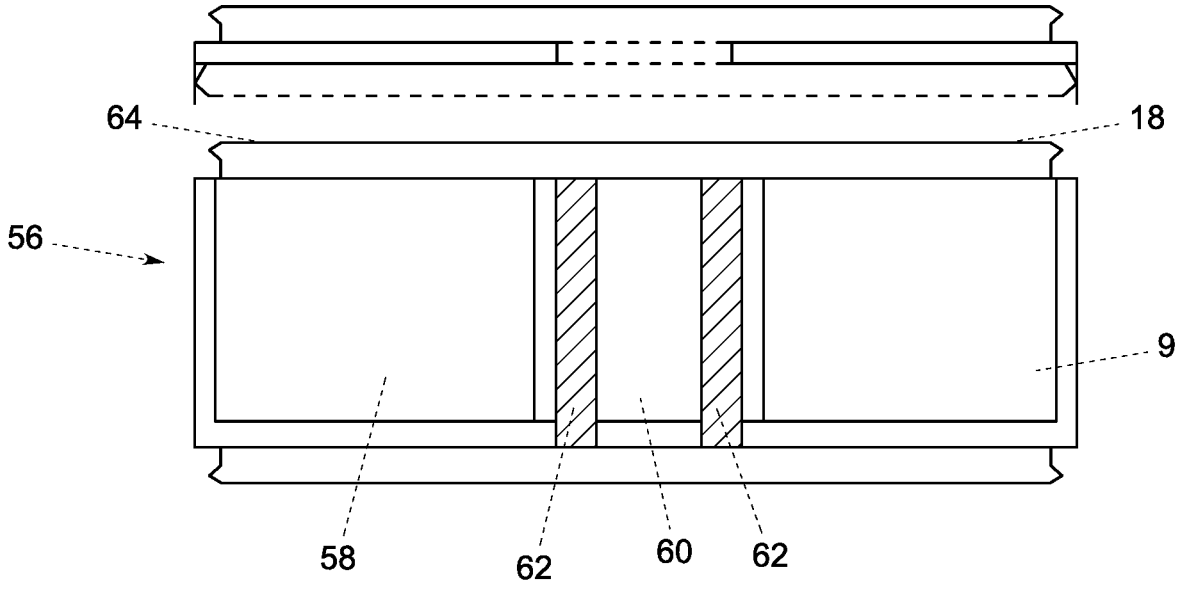
FIG. 3 is a front plan view of an accessories box, which is storage preferably for, for example, putty knife, putty, sandpaper, drywall mesh tape.

FIG. 3 is a front plan view of accessories box generally indicated at 56 and which comprises body (hollow for storage) 58 and brush handle channel 60, lined with brush holding seal 62. Box 56 is removably engagable at bottom surface 18 of container 14 by mating or other snap connection 64. Box 56 comprises lid 57.

Figure 4:
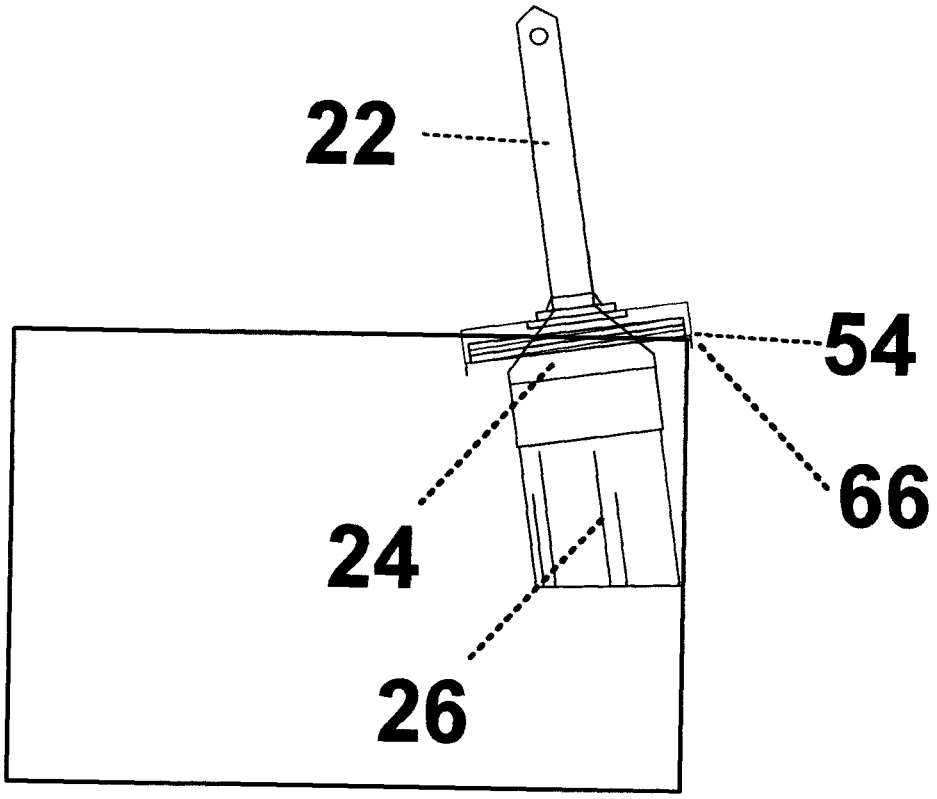
FIG. 4 is a front plan view of lid is engagement with brush and pegs on the lid securing a hold and placement of brush over a larger vessel, for example a paint tin.
Figure 6:
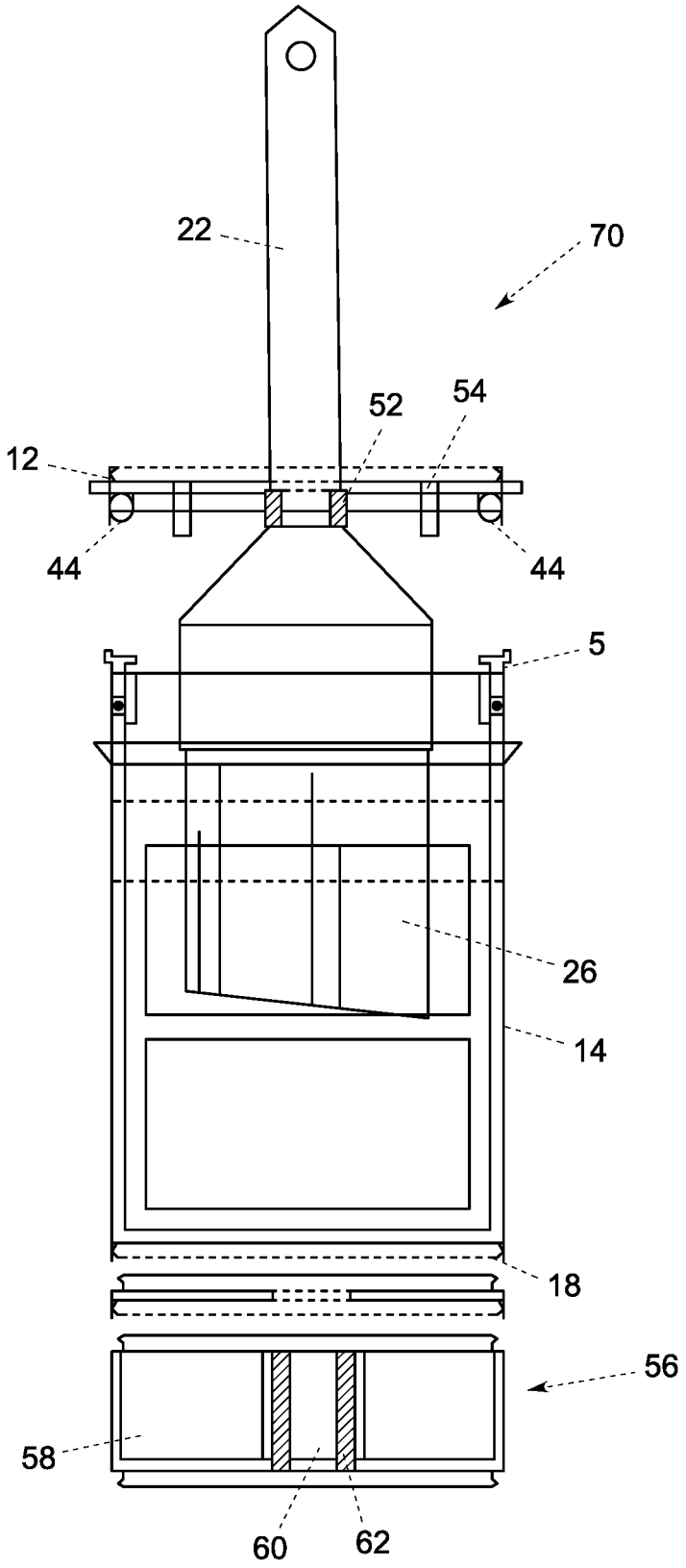
FIG. 6 is a front plan view of the entire device, showing in another embodiment, an accessories box being temporarily engaged with bottom of the container, while lid is opening and brush and lid are to be in use, wherein in this aspect, accessories box would otherwise, when device is not in use, be situated and engaged over top of the container.

FIG. 4 is a front plan view of lid 12 wherein peg 54 is hooked over edge 66 of vessel 68. in engagement with brush and pegs on the lid securing a hold and placement of brush over a larger vessel, for example a paint tin;

FIG. 6 is a front plan view of an entire device, shown generally at 70 (another embodiment), comprising an accessories box shown generally at 56 which is temporarily engaged bottom 18 of the container 14, while lid 12 is open and brush and lid are to be in use, wherein in this aspect, accessories box 56 would otherwise, when device is not in use, be situated and engaged over top of container 14, with handle 22 being disposed within brush handle channel 60 and secure in place with brush holding seal 62.

FIG. 7 is a top plan view of lid 61 and FIG. 8 is the bottom plan view thereof. Having opposing sides 72 and 74 and opposing ends 76 and 78. Latch indentations 80 hold latch clasps 82. Pegs 84 hold lid in place against other vessels. Seal 86 is disposed under lid 12. Within center of lid 61 there is provided an aperture 88 and channel 90, wherein aperture 88 is lined with an air-tight brush holding seal 92.

Figure 9:
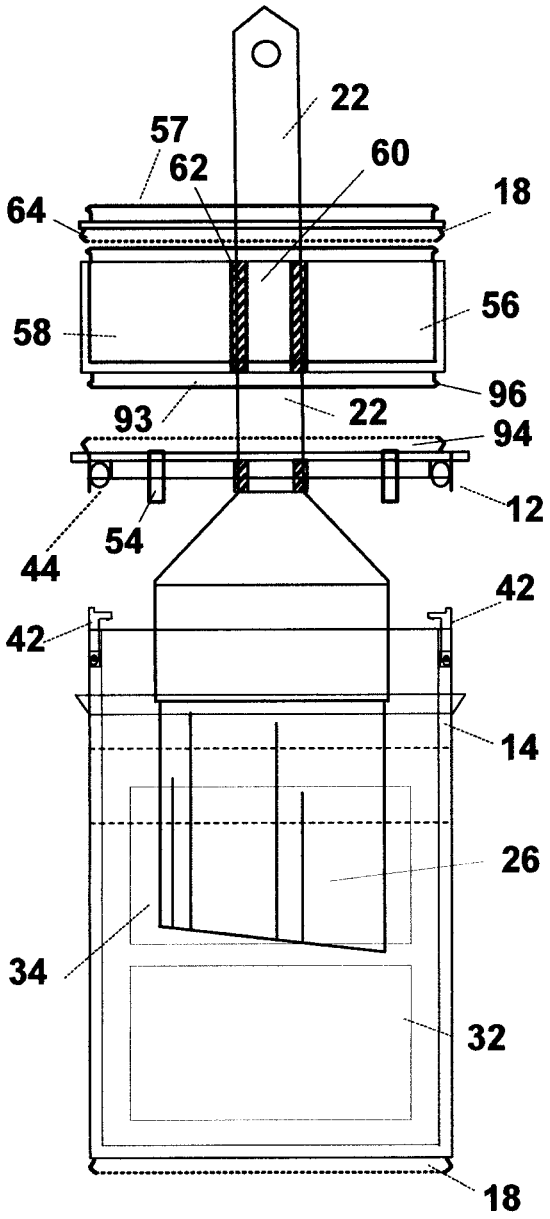
FIG. 9 is a front view of the device of FIG. 6 wherein accessories box is being placed for removable engagement with the top of the container.

FIG. 9 is a front view of the device of FIG. 6 wherein bottom surface 93 of accessories box 56 is placed for removable engagement with the top surface 94 of the lid 12. Such "locking" of the accessories box 56 on the lid 12 may be achieved by rotation of latch clasps 82 over accessories box base indentations 96, wherein they snap-fit.

Figure 10:
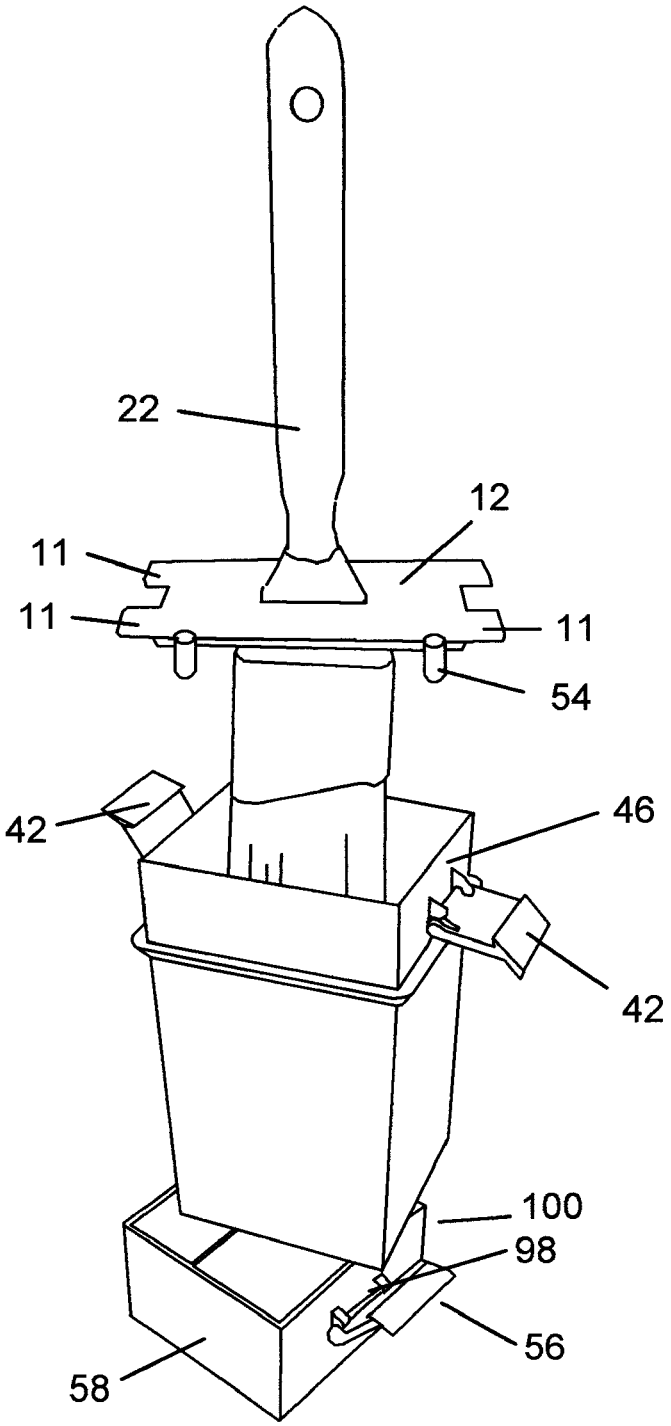
FIG. 10 is an exploded view of the device of the invention.

FIG. 10 is an exploded view of the device of the invention wherein lid 12 comprises extensions 11 for easy removal of lid, by hand, wherein latches 42 are clearly shown and wherein accessories box 56 is shown in slight disengagement from the bottom of container 14, exposing hollow 58 (there may be several compartments, as shown) and showing accessories latch 98, matable with container indentation or accessories box mating means 100.

Figure 11:
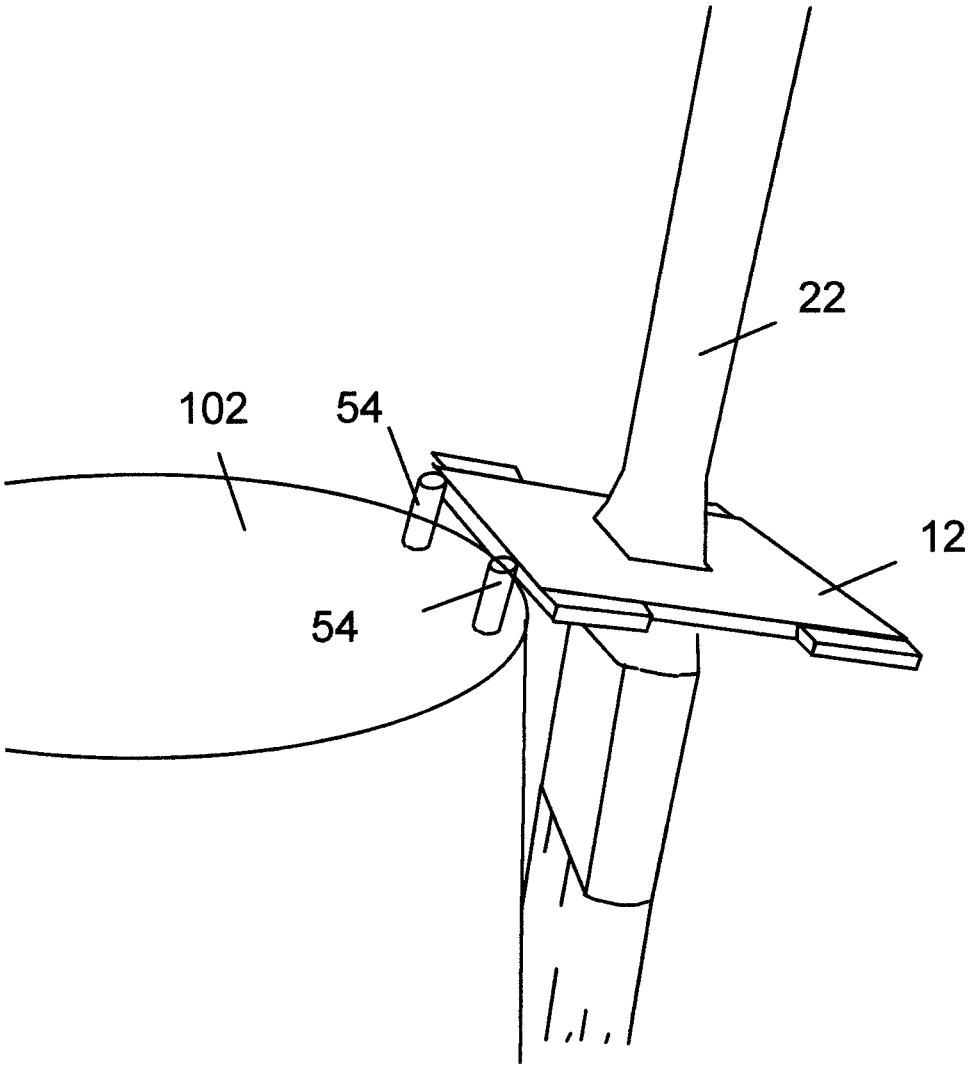
FIG. 11 is a perspective view of lid is engagement with brush and two pegs on the lid securing a hold and placement of brush over the side of the top of a large paint can.

FIG. 11 is a perspective view of lid 12 is engagement with brush handle 22 and. via pegs 54 is hanging upon vessel 102, a paint can. The two pegs on the lid secure a hold and placement of brush over the side of the top of a large paint can, with weight of the brush angling the brush to assist the pegs in assuring hold and placement.

Figure 12:
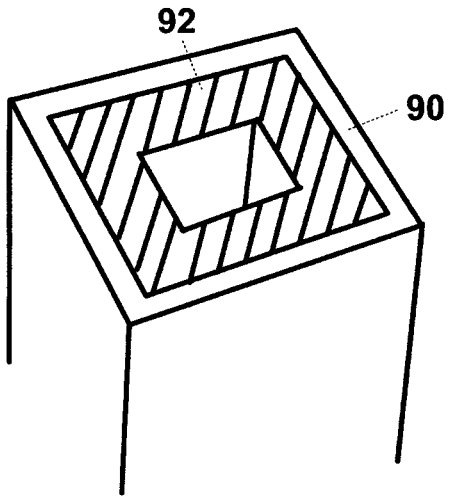
FIG. 12 is a perspective view of, in one embodiment, an aperture comprising a substantially air-tight, brush-holding seal, in this case, channel-surrounding foam.

FIG. 12 is a perspective view of, in one embodiment, aperture 88 and channel 90 comprising a substantially air-tight, brush-holding seal 92, in this case, channel-surrounding foam.

Figure 13:
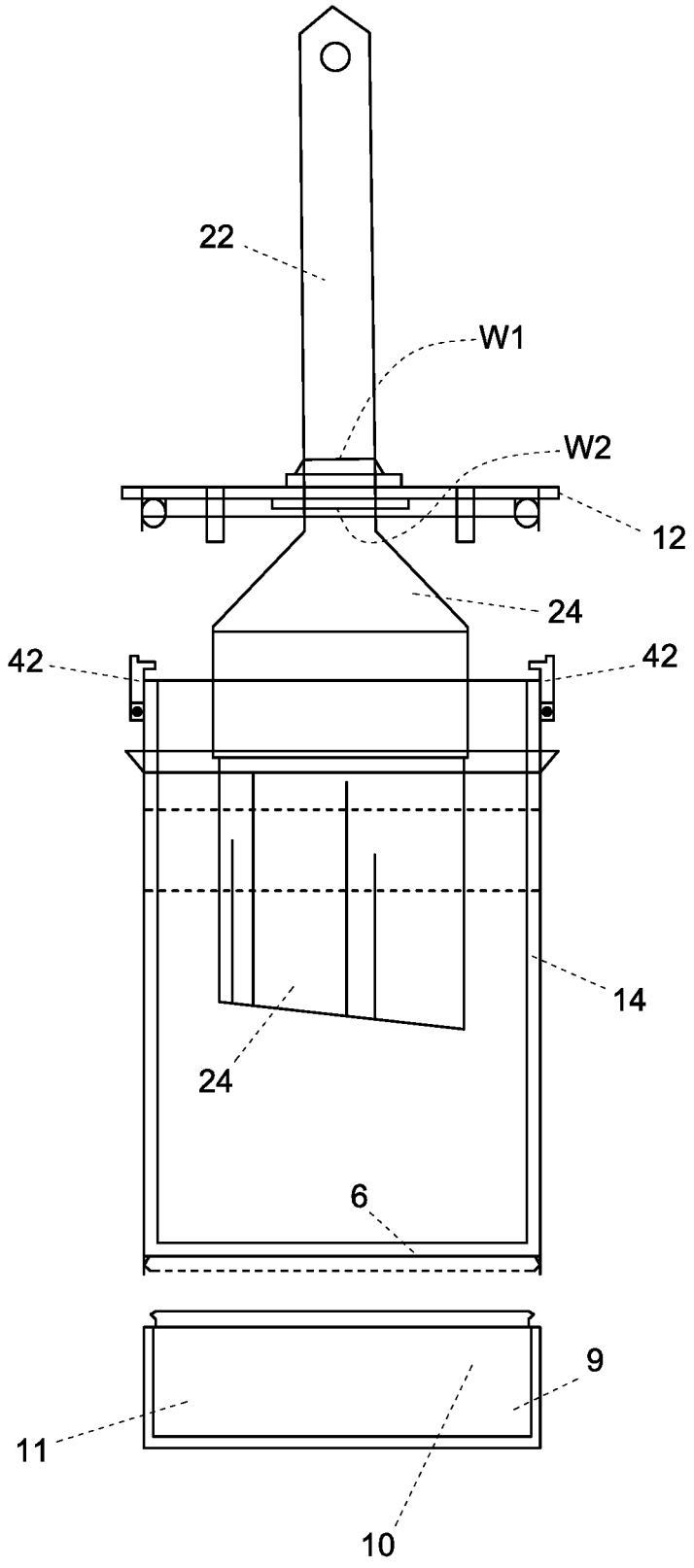
FIG. 13 is a front plan view of the entire device, showing brush and lid in one embodiment, an accessories box being engaged with bottom of the container.

FIG. 13 is a front plan view of the entire device, showing brush handle 22 and lid 12 in one embodiment, an accessories box 56 being engaged with bottom of the container 14.

Figure 14:
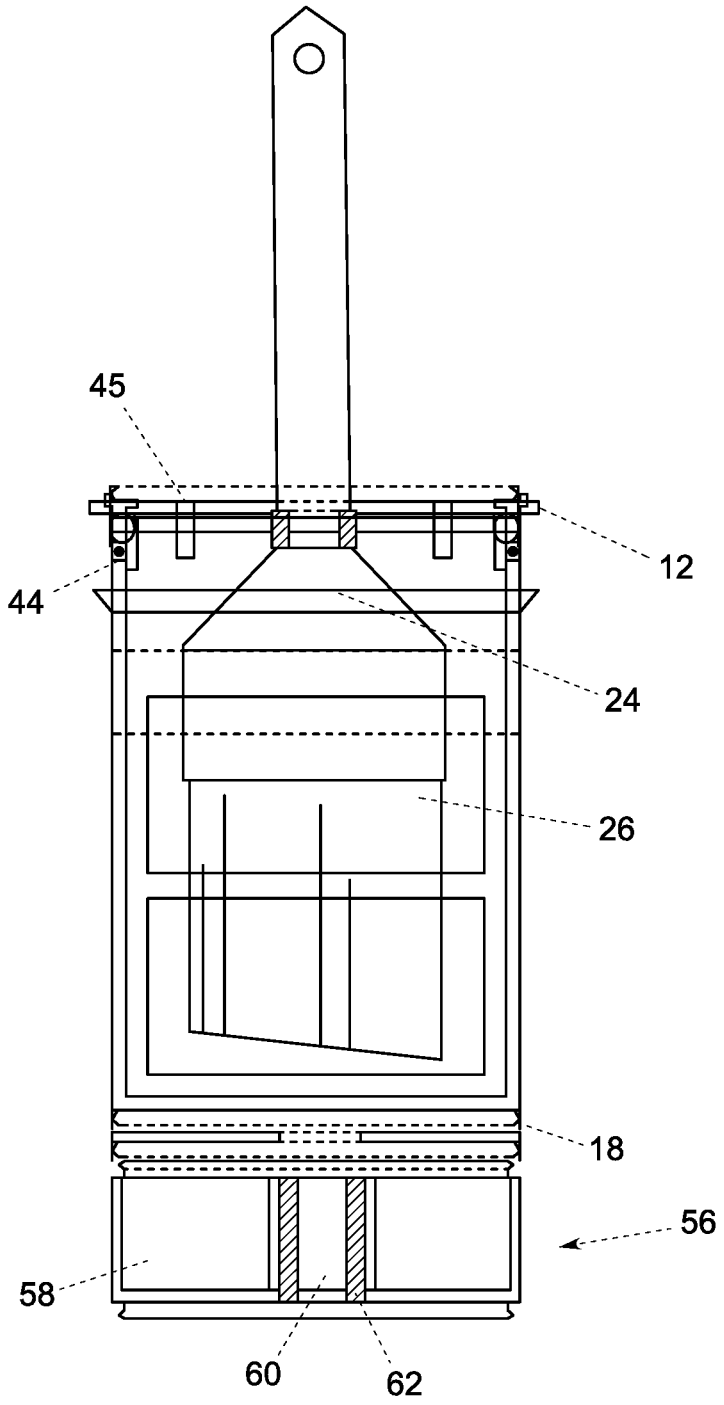
FIG. 14 is a front plan view of the entire device of FIG. 6 wherein the brush is engaged in the lid aperture and the lid is closed upon the top of the container.

FIG. 14 is a front plan view of the entire device of FIG. 6 wherein the brush is engaged fully in the lid aperture and the lid is closed upon the top of the container.

Figure 15:
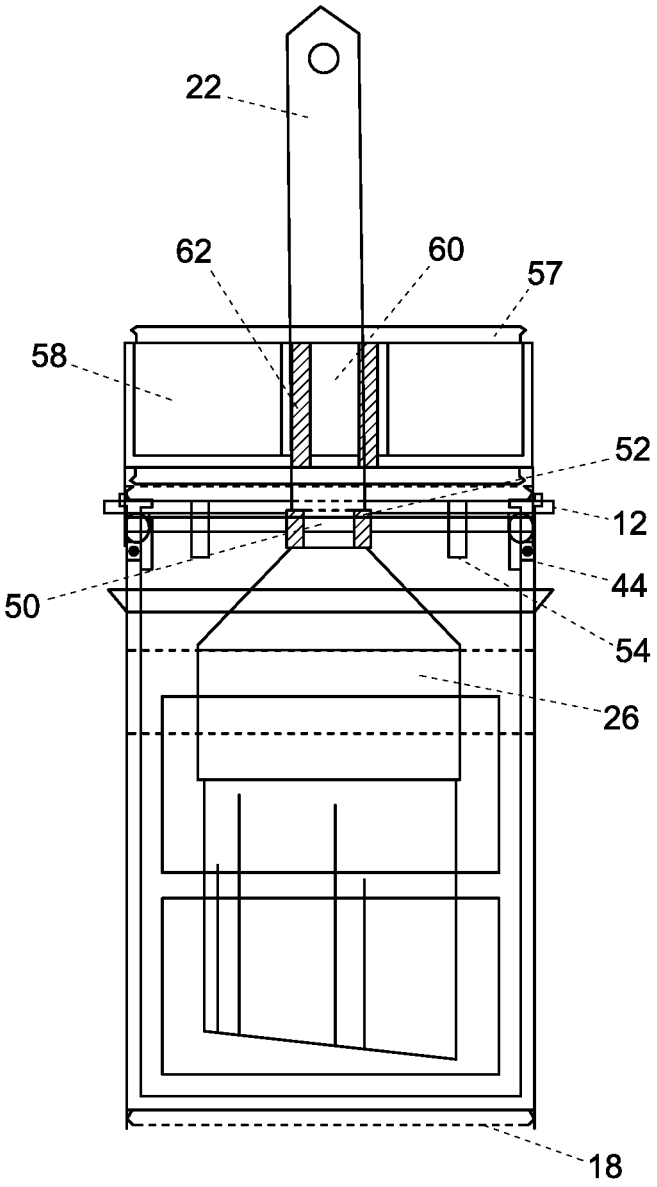
FIG. 15 is a front plan view of the entire device of FIGS. 6 and 14 wherein the brush is engaged in the lid aperture and the lid is closed upon the top of the container and accessories box is engaged in a secure storage and transport position above the container.
Figure 16:
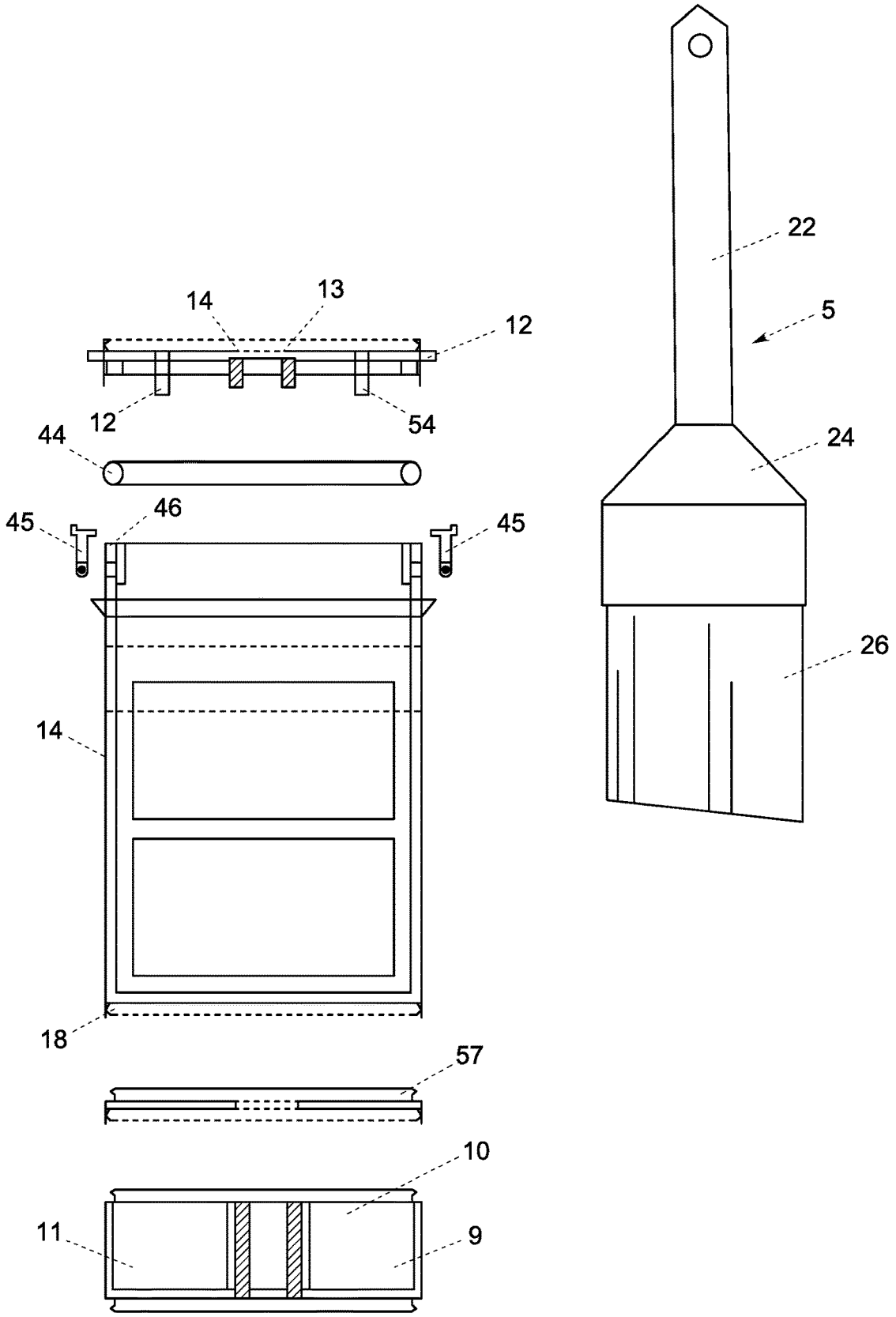
FIG. 16 is an exploded front view of the components of the device, in particular showing the lid the container and the accessories box in alignment for connection and wherein brush may or may be stored with the device and may or may be sold with the device.

FIG. 15 is a front plan view of the entire device of FIGS. 6 and 14 wherein the brush is engaged in the lid aperture and the lid is closed upon the top of the container and accessories box is engaged in a secure storage and transport position above the container;

FIG. 16 is an exploded front view of the components of the device, in particular showing the lid 12 the container 14 and the lid 57 of accessories box 56 in alignment for connection and wherein brush (shown generally at 5 and comprising handle 22, ferrule 24 and bristles 26) may or may be stored with the device and may or may be sold with the device. Seal 44 between lid 12 and top edge 46 of container 14

Figure 17:
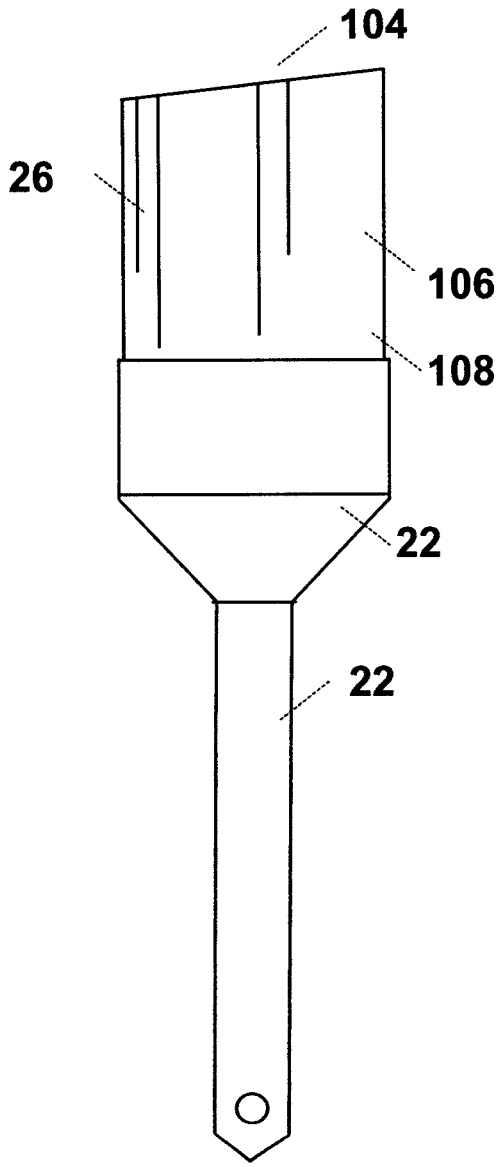
FIG. 17 depicts the parts of a brush.

FIG. 17 depicts the parts of a brush.

Further Notes on Figures

The container (aka paint bottle) if closed properly will preserve the paint for an extended period of time, up to 2 years. The less air in the bottle, the longer the paints usable product life. The size of the bottle will range in size due to the size of the brush and the use. The bottle opening should be wide enough so the desired brush is easily inserted with little effort and skill. This will allow the painter to use the bottle as the paint tray/bucket to draw paint from. The wide opening will also give the user a place to remove excess paint from the brush. This is the perfect gift for the professional painter who likes to leave a little gift to their clients to increase referrals and repeat business. The bottle may have a designated area where the professional painter can stick their business card. The tool will help the clients keep their new paint job looking great for longer and with little effort. The bottles also has a designated area where the appropriate paint color info can be noted: paint maker paint name, paint store, paint code, paint finish and locations the paint was used. (and or course the painter business card will be attached to the bottle for quick reference). The bottle may have a run catch or collar on the side of the bottle to catch paint runs. The run catch may go around the entire outside of the bottle to catch any runs that may occur. The bottle preferably has two latches that will swing in and out to engage the lid to ensure a close airtight fit. The lid preferably has a silicone seal that will mode itself to get a better airtight seal. The latch system will allow the unit to close even when the opening is covers with paint. The lid is designed to also open even if the opening is sealed with dried paint. If the opening of the bottle and the silicone is bonded together, the silicone seal part that bonded to the bottle will pull away from the lid as the silicone seal is only held in place due to expansion tension of the seal.

So the seal is still bonded to the bottle but one can still use the unit as normal as the lid is discounted to the silicone. This will give the user an opportunity to empty out the paint container and do the necessary cleaning. It is also difficult for paint to bond to silicone. The silicone seal is also removable to clean. The bottle will preferably have a minimum paint level indicator and the maximum paint level indicator. The minimum paint level indicator shows the user/customer the paint should be at this level to keep the brush wet and preserved. The maximum paint level indicator is to show the paint level is too high and it can start to get messy soon. The inside of the bottle will preferably be as smooth as possible for cleaning purposes. The bottle will preferably have 3-4 latches that will latch onto the lid to close. The lid will preferably have a ledge that will allow the latches to catch to seal the container. The latch system will still close easily and properly even when there is a number of layers of paint in the lid and bottle edge. In one preferred aspect, the latches are attached to the container/bottle as the lid will have to many parts on it, which will make it more difficult to use. The bottom of the bottle will snap on.

The design has the laches attached to the bottle so the latches do not block the sight line of the painter but since the brush is easily removed from the lid I was think can add a version that the latch can be on the lid and connect to the painter container.

On the lid for the paint container there are preferably two lips on each side of the lid that allows the user to hold on to the container and push off the lid.

On the preferably plastic lid, there is an easy latch open cap that would fit onto the opening of the container/bottle. The latches being on the bottle will improve the sight lines on the lid, making it easier to see while painting. The lid preferably has an opening with a silicone neck to suspend the paint brush in place. The opening for the brush in the lid will be oval in shape as the lid should be as far down the brush handle as possible to reduce fatigue in the painters hands. The sealed channel (preferably with silicone) or neck will stay in place just due to its form when it expands. The neck side wall with air tight foam has a set of washers W1 and W2, as shown in FIG. 13, on both sides of the lid to help keep it in place and improve the seal. 14) The opening for the brush handle in the lid will hold almost all standard house paint brushes. The lid also suspends the brush in place to avoid the brush resting on the bottom of the bottle. If the brush rests on the bottom for a period of time the bristles will be out of shape. The lid brush opening was designed to be air tight to eliminate air from entering the bottle. The clear plastic lid does not obstruct the painter line of sight when using the paintbrush to paint. The silicone neck or the foam neck can be removed for cleaning. The brush can also be detached from the silicone and the lid for cleaning. The brush lid will also act as a drip catcher for the messy painters but will not interfere with the painter ability to do their job. The lid on the brush will also prevent paint running down the brush into the painter's hands and arm. The lid will also prevent the brush from dropping into the paint bottle. The lid will also have two pegs that will allow you to suspended the brush in larger paint containers. The pegs will catch onto the lip of the larger container and the brush's weight will force the brush to lean against the wall of the container without falling in. The lid has preferably a silicone seal that will mode itself to get a better airtight seal. The latch system will allow the unit to close even when the opening is covered with paint. The lid was designed to be open even if the opening is sealed with dried paint. If the opening of the bottle and the silicone is bonded together, the silicone seal will pull away from the lid as the silicone seal is only held in place due to expansion of the seal. It is also difficult for paint to bond to silicone. The silicone seal is also removable to cleaning. There is an inside wall and outside wall that will hold the silicone seal in place.

When the lid is firmly tightened onto the jar, this forms a spin resistant paint container that will bring you peace of mind.

It is preferred to use special angle high quality polyester bristle paint brush for cutting into corners and trim work. The brush may also act as a stir stick for the paint as the brush bristles will also come close to touching the bottom of the bottle. The standard brush used may be a 1.5 inch brush angle brush. but larger brushes may also be used, as desired. As noted herein, the device need not include a brush, upon sale to a user.

As such, there are models with the brush inserted and models with brushes not inserted, this will typically be for the professional painters that have a brush of choice.

The accessories box comprises Filling Putty Putty Knife, and sandpaper and drywall tape. For deeper damage, more tools and work is need to repair the damage. Customers will need putty filler to fill in the damage. To do this they will need a putty knife and putty. 9) The putty (storage) container will be attached to the bottom of the paint bottle or attached to the top of the containers, using the paint bottle as the lid. The bottom of the bottle will have a treaded area so the putty container can be screwed onto the bottle. The Storage container will snap on to the bottom of the paint container.

The putty knife may be inserted into the box. The painter will need to do a little cleaning of the putty knife but that can be completed in seconds. The pre-cut 2.5×3 inch sandpaper will be inserted into a sleeve on the outside of the paint bottle.

Typical tools need for a paint repair with present invention touch up kit:

| | |
|---|---|
| 1)the paint, | inside the container/bottle |
| 2)tool to open paint can | lid |
| 3)stir stick | paint brush |
| 4)paint brush | paint brush |
| 5)sink to clean the brush | insert brush back into paint to keep it from drying. |
| DELUXE VERSION | |
| 6)putty | putty container (in storage box) |
| 7)putty knife | inside putty container (in storage box) |
| 8)sand paper | in storage box |
| 9)drywall mesh tapes/paper | in storage box |
| 10)mesh tape | in storage box |
| 11)moist wipe | in storage box |

General

This device can be used to increase the painter's speed on cutting edges. The device is light weight and of a convenient size to hold and control with little effort. The clear lid allows the painter to see easily into the containers while reloading the brush.

In some aspects of the invention, a kit is provided comprising the device (comprising i) container with lid, wherein lid comprises a paint brush aperture and channel; filled with a plug) and ii) at least one accessories box, attached at either the bottom surface of the container and/or at the top surface of the container.

In one aspect brushes are sold separately from the kit. In this embodiment, the lid aperture (through which a brush handle is later and prior to use inserted) is filled with a liquid and air-proof plug. This plug may be made of plastic, rubber, or other like materials.

In another aspect, a brush is included in the kit and is situated within the container such that the bristles are dipped in the paint housed therein (to prevent drying out) and wherein bristles are held from touching the bottom (interior) of the container by the configuration of the paint brush aperture and channel, within the lid. In addition, other small brushes may be included in the kit to allow the user to make small touch up repairs, allowing the user to reduce the amount of new paint applied to the repair and keep as much of the old paint as possible to keep the repairs as hidden as possible. In this aspect, the small brush can be stored in the accessories box and the used small brushes can be hung in the paint containers to keep it wet and ready for future repairs.

It is to be clear that the device can be sold with a brush or without a brush.

It is preferred that the container is of same shape and configuration as the accessories storage box so that latter can be seamlessly attached and be uniform with the container.

It is contemplated that a user will have one kit for each color in his/her house for the repair of small damages quickly and easily. Likewise a commercial user would have kits in each required colour on hand.

This product will be purchased by DYI consumers as well as by painting professionals. The professionals would use our RE-paint brush this to reduce setup time on common colors, like trim colors (eg. white semi gloss, high gloss white, ceiling white. etc) and on larger jobs with the same color in many areas. To have a tool like this while painting large projects will save a tremendous amount of time and energy in set up time. To the professional painter time is money and a open lid and paint system is profit. The paint will remain perfect for months if not years. The container is easy to open and close ever for the messiest painters.

The Professional painter who likes to leave a little gift to their clients to increase referrals and repeat business, this is the perfect gift. The tool will help the clients keep their new paint job looking great for longer and with little effort. The bottles will be filled with the appropriate paints and info paint name, paint store, paint code, paint finish and locations the paint was used. (and or course the painter business card will be attached to the bottle for quick reference). If the DIY repair does not look as nice as the client was hoping for, who would they call? The professional painter business card of course, as their business card and contact is right in their hand.

For the end user/DIY: The product would allow the customer to finish the paint job faster, with less effort and will better results. This would make painting a lot more enjoyable, productive and increase satisfaction level. If the customers used the correct tools this is very possible. The customer would also having a quick and easy way to repair their paint. This will give the customer, great looking walls for a longer period of time.

Additional Notes

The present invention provides:

1: All in one paint repair tool, the combination of the paint bottle, lid, brush, stir stick, putty, putty knife and sander paper in one unit wall repair kit 2: Plastic lid with the silicone neck that is airtight, that stays on the brush while being used.

3: Plastic lid with the silicone neck that acts as a drop catcher, run catcher and brush holder.

4: The lid has to pegs that will act as hooks that attach to larger paint bucket and will suspend the brush.

5: Opening will be oval in shape to allow brush to be inserted properly to reduce stress on hands while painting 6: Easy open, latch closing lid system, will operate properly even if it is covered with paint and if the paint is completed sealed. A twist system lid will have a difficult time opening once the paint seal the lead. Even if not seal 100%, even parts for semi wet paint parts will make opening and closing very difficult as the layers of paint starts to act as stops in the mechanic of the lid.

7: Opening will hold all standard burshes

8: Suspend brush to avoid deforming of bristles.

9: Lid can be dismantles to be cleaned, lid, neck and brush

10: You can insert aftermarket/replacement brushes into the lid

11: lid will stop brush from dropping into paint

12: Bottle has a run catch that would reduce runs of paint down the side of the bottle.

13: Wide month bottle to allow for paint tray use.

14: Designated areas for paint info and Painter business card

15: Bottle with lid and silicone neck or air tight foam will make an air tight container to store paint for years and keep brush wet for years and be ready to be used at anytime.

16: The Lid bottle will act as the lid for the putty fill.

17: Putty Fill container will snap on to the bottom of the Paint container.

18: The Putty knife, will fit into the putty container.

19: The Inventions will store the paint and keep the brush in operation state for years.

20: The user only needs to unlatch the lid and paint. This may be for repair situations or painting trim for a new project. Set up time and preparation time to start painting is reduce to near zero.

21: Shutdown time and to store time and efforts is also reduce to near zero. Latch and Seal and store away.

22: The silicone used as the lid seal will make if very difficult for paint to attached itself to the silicone thus making it very difficult to seal the container shut.

23: Storage unit can be attached to the top of the lid of the paint container

24: Pass through in the storage containers will allow the brush handle to pass through and allow the storage unit to sit on top of the paint container 25: foam in the pass through the provide a snug grip on the brush handle and keep the unit in place.

26: clear lid on the storage to see the drywall repair supplies.

As will be apparent to those skilled in the art, the various embodiments described above can be combined to provide further embodiments. Aspects of the present systems, methods and components can be modified, if necessary, to employ systems, methods, components and concepts to provide yet further embodiments of the invention. For example, the various devices and methods described above may omit some parts or acts, include other parts or acts, and/or execute acts in a different order than set out in the illustrated embodiments.

Further, in the methods taught herein, the various acts may be performed in a different order than that illustrated and described. Additionally, the methods can omit some acts, and/or employ additional acts.

These and other changes can be made to the articles in light of the above description. In general, in the following claims, the terms used should not be construed to limit the invention to the specific embodiments disclosed in the specification and the claims, but should be construed to include all possible embodiments along with the full scope of equivalents to which such claims are entitled. Accordingly, the invention is not limited by the disclosure, but instead its scope is to be determined entirely by the following claims.

I claim:

1. A device for use in paint touch-ups using a brush comprising a handle, bristles and a ferrule, the device comprising:

a paint container for holding paint, said container comprising a top, a bottom and body there between, wherein said top comprises an opening to an interior of the body;

a lid which is engagable with the top to provide a removable sealing and closure thereof, said lid comprising an aperture and a paint brush channel through the lid, such that, when stored in the device, the handle extends outwardly away from the container and is grippable above the container, said handle extendable through the aperture in the lid and through the paint brush channel so that the ferrule and the bristles are disposed within the body of the container;

an air-tight, brush-holding seal disposed in the aperture of the lid, said air-tight, brush-holding seal enables suspension of the brush above the bottom of the container while at the same time enabling detachment of the brush from the lid, when a replacement of the brush is desired, wherein the airtight, brush holding seal comprises a silicone neck disposed in the aperture of the lid, and at least two washers, the one disposed above the silicone neck and one below the silicone neck to assist in holding the brush in place, in relation to the lid; and a sealable-accessories box removably attachable to the container, wherein the sealable-accessories box is removably engageable with the container at two postitions, the sealable-accessories box comprises:

base indentations formed at a base of the sealable-accessories box, the base indentations removably coupled with a top of the lid when the brush and the lid are not in use, and, an accessories latch formed at a top of the sealable-accessories box, the sealable-accessories box to be removably coupled with a container indentation at the bottom of the paint container when the brush and the lid are to be used.

2. The device of claim 1, wherein the accessories box is removably attached to the bottom of the container.

3. The device of claim 2, wherein the accessories box snaps onto bottom of the container.

4. The device of claim 1, wherein the accessories box comprises a top, a bottom and a body there between and additionally comprises a hollow channel extending between the top and the bottom, said box providing a storage space in an interior of the body around the hollow channel, said hollow channel comprising a second brush holding seal such that when the device is not in use, the accessories box is positionable on top of the container, with the handle of the brush extending through the hollow channel and secured in place by the second brush holding seal.

5. The device of claim 4, wherein the second brush holding seal comprises silicone and/or foam.

6. The device of claim 1, wherein a spill collar is disposed around an exterior surface of the container, proximate to the top.

7. The device of claim 1, wherein the aperture is oval.

8. The device of claim 1, wherein, in use, the brush is removable from the container and is usable for painting touch-ups while attached to the lid.

9. The device of claim 1, wherein the brush to removable from the lid for replacement and cleaning.

10. The device of claim 1, wherein the lid is engagable with the container by a plurality of latches.

11. The device of claim 1, wherein the lid comprises pegs for suspension of the brush onto one of lips or edges of other vessels, when in use, said pegs being oriented such that weight of the brush serves to facilitate hanging the brush against a wall of the vessel.

12. The device of claim 1, further comprising a removable silicone seal between the lid and the container.

13. The device of claim 1, wherein the airtight, brush holding seal comprises silicone and/or foam.

14. The device of claim 1, wherein the airtight, brush holding seal comprises a silicone neck to assist in holding the brush in place, in relation to the lid.

15. The device of claim 1, wherein the lid is twist off.

16. The device of claim 1 further comprising a paint stir stick.

17. The device of claim 1, wherein the accessories box comprises one or more the following: putty, putty knife, sand paper, drywall mesh tape and paper, paint edging tape and sealed paint remover-soaked handy cloths.

18. The device of claim 1, wherein aperture in the lid is customizable to sizes of the brush.

* * * * *